United States Patent [19]

Fukui et al.

[11] 4,080,202

[45] Mar. 21, 1978

[54] COBALT BASE ALLOY

[75] Inventors: Yutaka Fukui; Tetsuo Kashimura; Fumio Hataya, all of Hitachi, Japan

[73] Assignee: Hitachi, Ltd., Tokyo, Japan

[21] Appl. No.: 666,356

[22] Filed: Mar. 12, 1976

[30] Foreign Application Priority Data

Mar. 12, 1975 Japan ..... 50-29038

[51] Int. Cl.[2] ..... C22C 19/07

[52] U.S. Cl. ..... 75/171; 148/32.5

[58] Field of Search ..... 75/171, 170; 148/32, 148/32.5

[56] References Cited

U.S. PATENT DOCUMENTS 3,582,320 6/1971 Herchenroeder ..... 75/171

*Primary Examiner*—R. Dean

*Attorney, Agent, or Firm*—Beall & Jeffery

[57] ABSTRACT

A cobalt base alloy consisting essentially of, in weight percent, about 0.1% to about 0.5% carbon, about 0.3% to about 2.0% silicon, about 0.3% to about 2.0% manganese, about 5.0% to about 15.0% nickel, about 26.0% to about 35.0% chromium, about 3.0% to about 10.0% tungsten, about 0.003% to about 0.1% boron, about 0.01% to about 1.0% titanium, about 0.01% to about 1.0% niobium and optionally about 0.05% to about 1.0% mischmetal and the balance being essentially cobalt together with impurities and incidental elements normally associated with a cobalt base alloy, which has high strength and high ductility even at high temperatures and is especially suitable as a material to be used at high temperatures under high thermal stress, such as a material for a nozzle of a gas turbine engine.

4 Claims, 13 Drawing Figures

COBALT BASE ALLOY

BACKGROUND OF THE INVENTION (1) Field of the Invention

The present invention relates to a cobalt base alloy. More particularly, the invention relates to a cobalt base alloy having in combination a high strength and a high ductility at high temperatures.

(2) Description of the Prior Art

Nozzles of gas turbine engines are used at such high temperatures as 800° to 1000° C, over a period of 20,000 to 30,000 hours, and they receive high thermal stress by violent heating or cooling at the time of starting up or shutting down. During the operation, they also receive heat stress caused by non-uniform temperature distribution. As a material for a gas turbine engine nozzle used under these severe conditions, there have heretofore been used cobalt base alloys, and investigations are now being made to develop cobalt base alloys having higher thermal fatigue resistance.

Most attempts heretofore made to develop novel cobalt base alloys are directed to improvements of the strength at high temperatures, especially the creep rupture strength. Namely, it has been considered that development of alloys having a high creep rupture strength will be in conformity with development of alloys having a high resistance to the thermal fatigue. However, nozzles prepared from cobalt base alloys heretofore developed are still insufficient in the resistance to the thermal fatigue and cracks are often formed in these nozzles.

We conducted research on formation of cracks in these cobalt base alloys and found that not only the high temperature strength but also the high temperature ductility is a factor having important influences on the resistance to the thermal fatigue in cobalt base alloys.

As pointed out hereinbefore, gas turbine nozzles are used at operation temperatures of 800° to 1000° C. The time required for elevating the temperature to this level at starting of a turbine is generally about 10 to about 20 minutes. Accordingly, the nozzle material receives a very high thermal stress at the time of starting. Further, even during the operation, the temperature is often changed and the nozzle material also receives a thermal stress during the operation of the turbine. These thermal stresses are gradually accumulated as residual stress. The residual stress increases with the lapse of time but the strength resisting this residual stress, namely the high temperature strength, is gradually reduced with the lapse of time. Accordingly, a crack is formed when the nozzle material cannot resist the residual stress any more. This residual stress causing cracking can be reduced if the material has a high ductility. More specifically, the generated thermal stress is moderated in a short time by the ductility of the material and accumulation of the stress can be remarkably reduced. Therefore, a material of a gas turbine nozzle should have, in combination, a strength resisting the residual stress, namely a sufficient high temperature strength, and a strength moderating the thermal stress, namely a sufficient high temperature ductility.

Conventional cobalt base alloys which have been developed as a result of attempts to improve only the high temperature strength, namely the creep rupture strength, for example, alloy No. P illustrated in the Example given hereinafter, are insufficient in the ductility, especially the ductility at high temperatures exceeding 900° C.

SUMMARY OF THE INVENTION

Objects of the Invention

It is a primary object of the present invention to provide a cobalt base alloy having a high resistance to the thermal fatigue.

Another object of the present invention is to provide a cobalt base alloy having a high strength at high temperatures.

Still another object of the present invention is to provide a cobalt base alloy having a high ductility at high temperatures.

Summary of the invention

According to the conventional techniques, the improvement of the high temperature strength in cobalt base alloys has been accomplished by addition of large quantities of solid-soluble reinforcing elements such as tungsten and molybdenum, addition of minute amounts of titanium and aluminum for precipitation of reinforcing $\gamma'$-phases or addition of carbide-forming elements such as tungsten, molybdenum, niobium and tantalum.

Although it is known that addition of the foregoing elements is effective for improving the high temperature strength, their effects on the high temperature ductility has hardly been examined. In conventional cobalt base alloys, the ductility is drastically lowered at temperatures higher than 900° C. The following cause is considered for this reduction of the ductility at high temperatures.

In conventional cobalt base alloys, the strength is improved by precipitation of carbides. The precipitation of carbides advances excessively at temperatures higher than 900° C. and as a result, the carbides grow, coarsen and cohere. Among these carbides, secondarily precipitated carbides are formed densely in the grain boundary. Accordingly, deformation of the alloy in the grain boundary becomes difficult. Further, the primary eutectic carbides are formed in the lamellar state and deformation of the carbides per se becomes difficult. Accordingly, the ductility of the alloy is drastically lowered.

In cobalt base alloys, chromium is generally incorporated at a high content so as to increase the resistance to oxidation. Accordingly, at the alloy casting, a non-metallic inclusion, presumed as an oxide, appears in a band-like or film-like form in the grain boundary. At the temperature lower than 900° C, the precipitation of carbides does not advance excessively and a deformation of the matrix is easier than that along the grain boundary by nature. Accordingly, the ductility is not lowered by deformation of the matrix in spite of the appearance of the non-metallic inclusion. But as pointed out hereinbefore, at temperatures higher than 900° C., large amounts of carbides are precipitated also in the matrix to reinforce the matrix, and hence, deformation of the matrix becomes more difficult than that along the grain boundary. Accordingly, because of the presence of the above non-metallic inclusion, deformation in the grain boundary is made difficult, and hence, the ductility is further lowered. At temperatures higher than 900° C., also nitrides are precipitated and these nitrides may be another cause of reduction of the ductility in the alloy.

One of critical features of the present invention is that titanium and niobium and and optionally also mischmetal, which have effects of finely dispersing eutectic carbides and grain boundary carbides in a cobalt base alloy, preventing secondary precipitation of carbides in the grain boundary and reducing oxygen and nitrogen contents by high deoxidizing and denitrificating activities, are incorporated in a cobalt base alloy. By addition of the foregoing additives, a cobalt base alloy having higher strength and ductility at high temperatures approximating 982° C. (1800° F.), than conventional cobalt base alloys can be obtained.

More specifically, the cobalt base alloy of the present invention consisting essentially of, in weight percent, about 0.1% to about 0.5% carbon, about 0.3% to about 2.0% silicon, about 0.3% to about 2.0% manganese, about 5.0% to about 15.0% nickel, about 26.0% to about 35.0% chromium, about 3.0% to about 10.0% tungsten, about 0.003% to about 0.1% boron about 0.01% to about 1.0% titanium and about 0.01% to about 1.0% niobium, and the balance being essentially cobalt together with impurities and incidental elements normally associated with a cobalt base alloy.

A cobalt base alloy of the above composition further comprising about 0.05% to about 1.0% mischmetal is also effective.

DESCRIPTION OF THE PREFERRED EMBODIMENTS

Figure 1A:
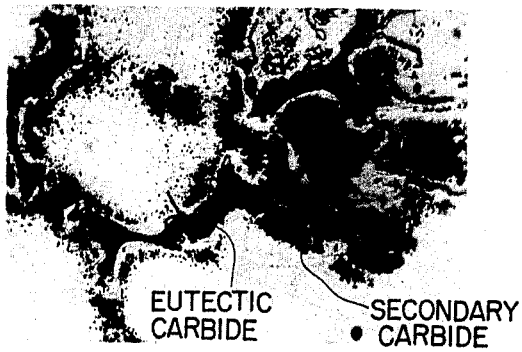
FIG. 1 shows microscopic photographs of 400 magnifications illustrating the microstructures of cobalt base alloys, in which FIG. 1-a shows a conventional cobalt base alloy, FIG. 1-b shows a cobalt base alloy of the present invention comprising titanium and niobium and FIG. 1-c shows a cobalt base alloy of the present invention comprising titanium, niobium and mischmetal.

The composition of the cobalt base alloy of the present invention has been decided for the following reasons.

Carbon is added to improve the strength of the alloy. When the amount of added carbon is smaller than 0.10%, a desired strength cannot be obtained. When the amount of carbon is larger than 0.50%, cohesion of carbides takes place if the alloy is allowed to stand still at high temperatures for a long time and the high temperature ductility is reduced. Accordingly, carbon is preferably incorporated in an amount of 0.10 to 0.50%, especially 0.20 to 0.30%.

By addition of silicon the resistance to oxidation is improved in the alloy and attainment of a deoxidizing effect is expected. When the amount of added silicon is smaller than 0.3%, no deoxidizing effect is obtained, and when silicon is incorporated in an amount larger than 2.0%, it is left as an inclusion at the alloy casting. Accordingly, silicon is preferably incorporated in an amount of 0.3 to 2.0%.

Manganese is added as a deoxidizing agent as well as silicon. When the amount of manganese added is smaller than 0.3%, no deoxidizing effect is obtained, and when manganese is incorporated in an amount larger than 2.0%, the oxidation resistance of the alloy is reduced. Accordingly, manganese is preferably incorporated in an amount of 0.3 to 2.0%.

Nickel is incorporated to improve the high temperature strength of the alloy. When the amount of nickel added is smaller than 5.0%, no substantially effect is obtained, and when nickel is incorporated in an amount larger than 15.0%, the strength is not so highly improved even with increase of the amount of nickel. Accordingly, it is preferred that nickel be incorporated in an amount of 5.0 to 15.0%, especially 9.5 to 11.5%.

Chromium is added to improve the oxidation resistance of the alloy. The limit providing a substantial effect is 26.0%. When the amount of chromium added exceeds 35%, formation of a non-metallic inclusion or internal oxidation of carbides at high temperatures is caused to occur, and hence, the high temperature ductility is reduced and the alloy becomes brittle when used at high temperatures. Accordingly, it is preferred that chromium be incorporated in an amount of 26 to 35%, especially 28.5 to 30.5%.

Tungsten is added to improve the high temperature strength of the alloy. No substantial effect is obtained when the amount of tungsten added is smaller than 3.0%. When tungsten is incorporated in an amount exceeding 10.0%, the oxidation resistance of the alloy is reduced. Accordingly, it is preferred that tungsten be incorporated in an amount of 3.0 to 10.0%, especially 6.5 to 7.5%.

Boron is added to improve the high temperature strength of the alloy. No substantial effect is obtained when the amount of boron added is smaller than 0.003%. When boron is incorporated in an amount exceeding 0.1%, the weldability of the alloy is reduced. Accordingly, it is preferred that boron be incorporated in an amount of 0.003 to 0.1%, especially 0.005 to 0.015%.

Titanium and niobium are generally used as carbide-precipitating reinforcing elements in the field of production of heat resistance steels. The cobalt base alloy of the present invention is a cast material different from a heat-resistant steel and it is used at high temperatures such as 982° C. (1800° F.) where no reinforcing effect can be expected by precipitated carbides. In the cobalt base alloy of the present invention, titanium and niobium are added in combination to exhibit effects of preventing secondary precipitation of carbides and cohesion of secondarily precipitated carbides and eutectic carbides. Further, by addition of titanium and niobium, there can be attained an effect of reducing the oxygen and nitrogen contents in the alloy by their deoxidizing and denitriding activities.

When the amount added of each of titanium and niobium is smaller than 0.01%, no substantial effect is obtained, and when they are incorporated in amounts exceeding 1.0%, an inclusion is formed and cohesion of carbides is readily caused and in the case of niobium, the oxidation resistance of the alloy is reduced. Accordingly, it is preferred that each of titanium and niobium be incorporated in an amount of 0.01 to 1.0%, especially 0.1 to 0.6%.

Mischmetal is incorporated in addtion to the above-mentioned titanium and niobium to enhance the effects attained by addition of titanium and niobium. Mischmetal is an alloy of rare earth metals comprising as main components cerium and lanthanum. Commercially available products of mischmetal comprises 52% cerium, 24% lanthanum, 18% niobium and 5% praseodymium. Any of mischmetal products can be used in the present invention, so far as it comprises as main components cerium and lanthanum. When mischmetal is added in an amount smaller than 0.05%, no substantial effect is obtained, and when it is incorporated in an amount exceeding 1.0%, an inclusion is formed. Accordingly, it is preferred that mischmetal be incorporated in an amount of 0.05 to 1.0%.

For the purpose of giving those skilled in the art a better understanding of the invention and/or a better appreciation of the advantages of the invention, the following illustrative example is given.

EXAMPLE

Cobalt base alloys having a composition indicated in Table 1 were prepared as samples. Alloy No. P is a conventional alloy free of titanium and niobium. Alloys Nos. A to J are cobalt base alloys within the invention. Among them, alloys Nos. B, F and H comprise 0.3% of mischmetal in addition to titanium and niobium.

Table 1

| Alloy No. | (unit: %) | | | | | | | | |
|---|---|---|---|---|---|---|---|---|---|
| | C | Si | Mn | Ni | Cr | W | B | Nb | Ti |
| P | 0.28 | 0.60 | 0.49 | 11.00 | 30.75 | 7.02 | 0.014 | — | — |
| A | 0.24 | 0.98 | 1.01 | 10.28 | 28.35 | 6.84 | 0.014 | 0.15 | 0.12 |
| B* | 0.24 | 0.98 | 1.00 | 10.28 | 28.35 | 6.90 | 0.014 | 0.36 | 0.07 |
| C | 0.24 | 0.96 | 1.00 | 10.18 | 28.00 | 6.84 | 0.015 | 0.32 | 0.04 |
| D | 0.25 | 1.10 | 1.09 | 10.22 | 27.80 | 6.74 | 0.015 | 0.16 | 0.23 |
| E | 0.24 | 1.10 | 1.10 | 10.22 | 27.80 | 7.70 | 0.015 | 0.30 | 0.17 |
| F* | 0.25 | 1.10 | 1.10 | 10.28 | 27.80 | 7.74 | 0.015 | 0.29 | 0.13 |
| G | 0.25 | 1.15 | 1.05 | 10.32 | 27.45 | 6.90 | 0.015 | 0.30 | 0.24 |
| H* | 0.25 | 1.13 | 1.04 | 10.22 | 27.25 | 6.90 | 0.015 | 0.29 | 0.20 |
| I | 0.25 | 1.12 | 1.13 | 10.18 | 27.35 | 6.70 | 0.015 | 0.52 | 0.25 |
| J | 0.25 | 1.15 | 1.13 | 10.22 | 27.70 | 6.90 | 0.015 | 0.51 | 0.34 |

*0.3 % mischmetal was incorporated in addition to the above elements.

Figure 1B:
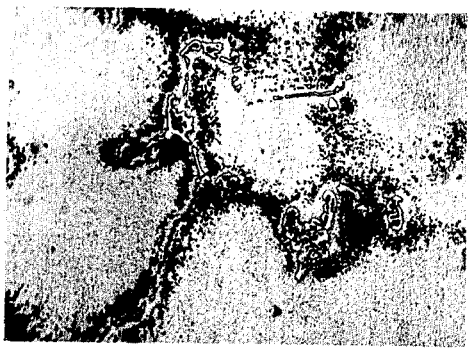
Figure 1C:
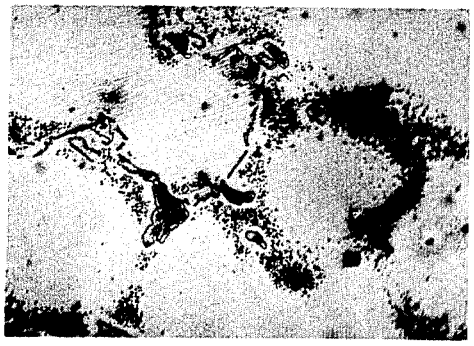
Figure 2A:
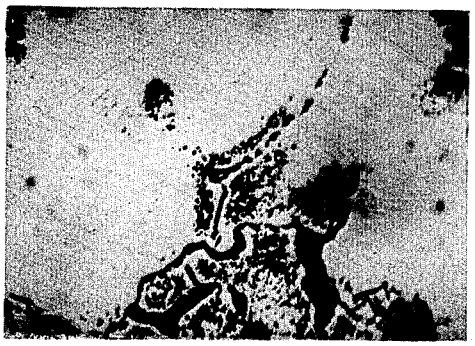
FIG. 2 shows microscopic photographs illustrating the microstructures of cobalt base alloys after the creep rupture test, in which FIG. 2-a shows a conventional cobalt base alloy of 400 magnifications, FIG. 2-b shows the ruptured face of the alloy of FIG. 2-a of 100 magnifications, FIG. 2-c shows a cobalt base alloy of the present invention comprising titanium, niobium and mischmetal of 400 magnifications and FIG. 2-d shows the ruptured face of the alloy of FIG. 2-c of 100 magnifications.
Figure 2B:
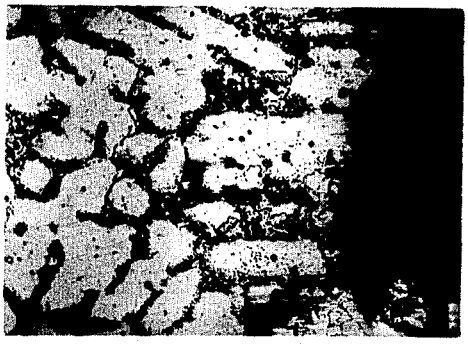
Figure 2C:
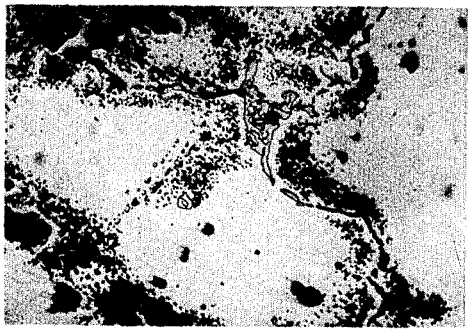
Figure 2D:
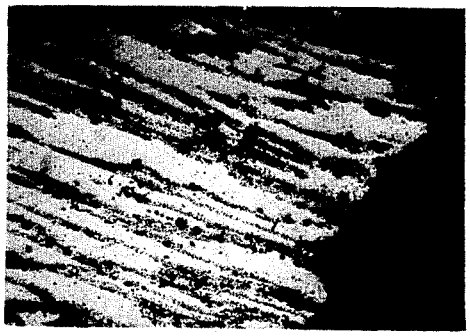
Figure 3A:
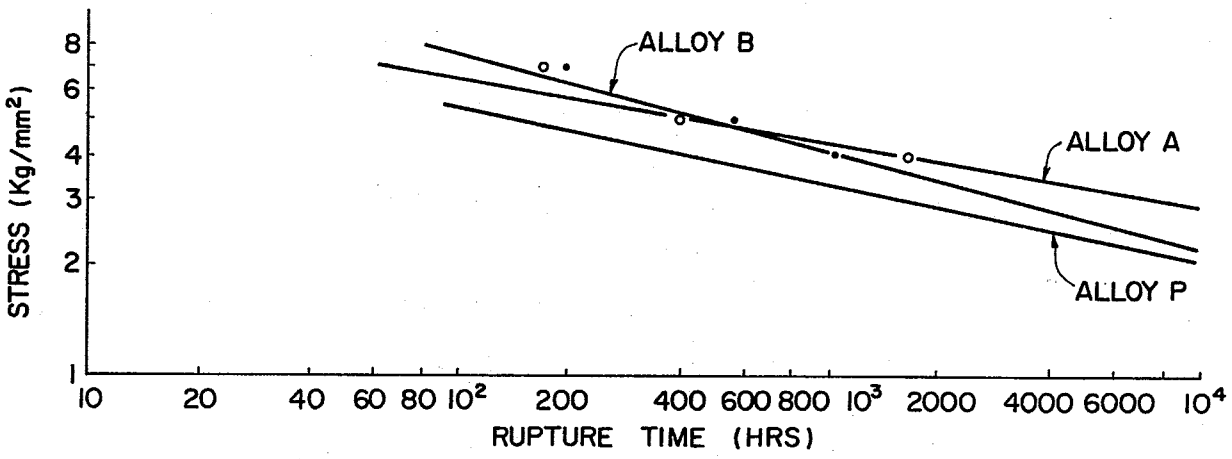
FIGS. 3-a to 3-e are graphs showing results obtained when samples of the conventional cobalt base alloy and samples of the cobalt base alloy of the present invention were subjected to the creep rupture test at 982° C., in each of which the abscissa denotes the rupture time (hours) and the ordinate denotes the stress (Kg/mm$^2$).
Figure 3B:
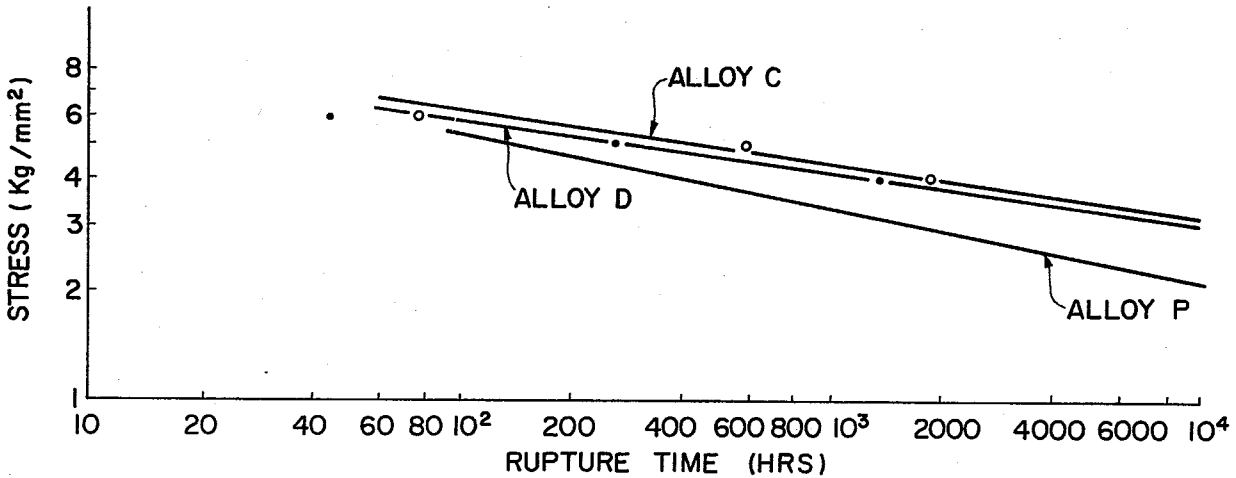
Figure 3C:
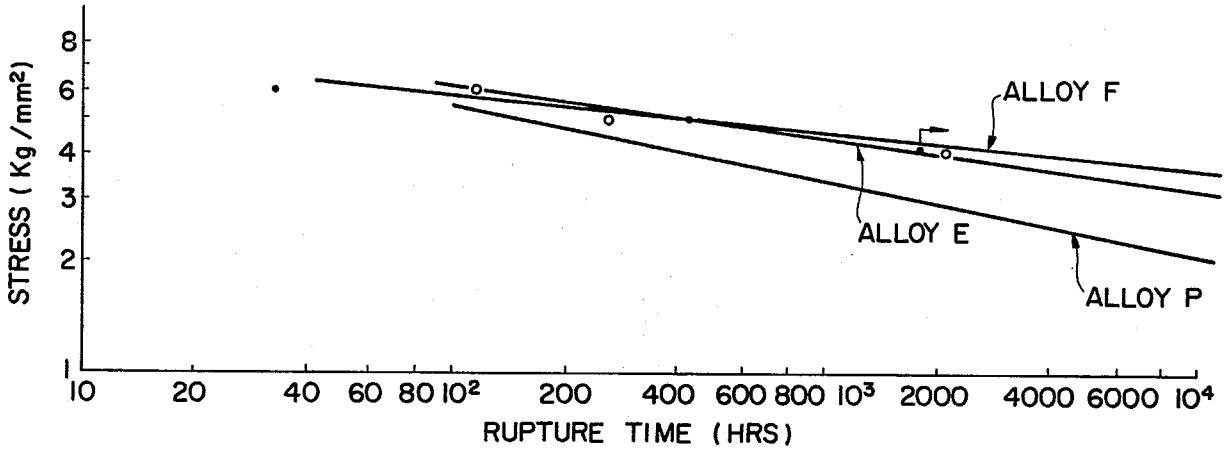
Figure 3D:
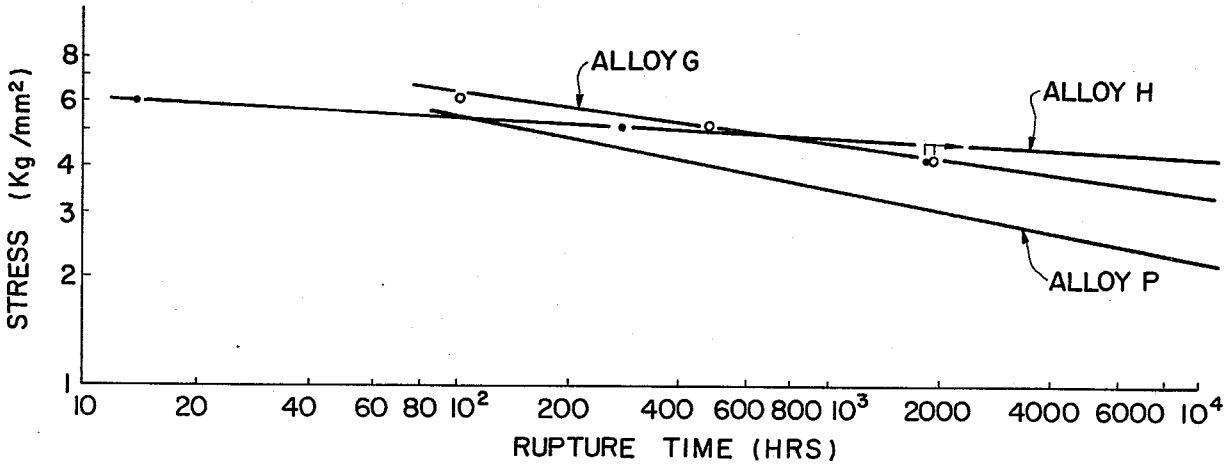
Figure 3E:
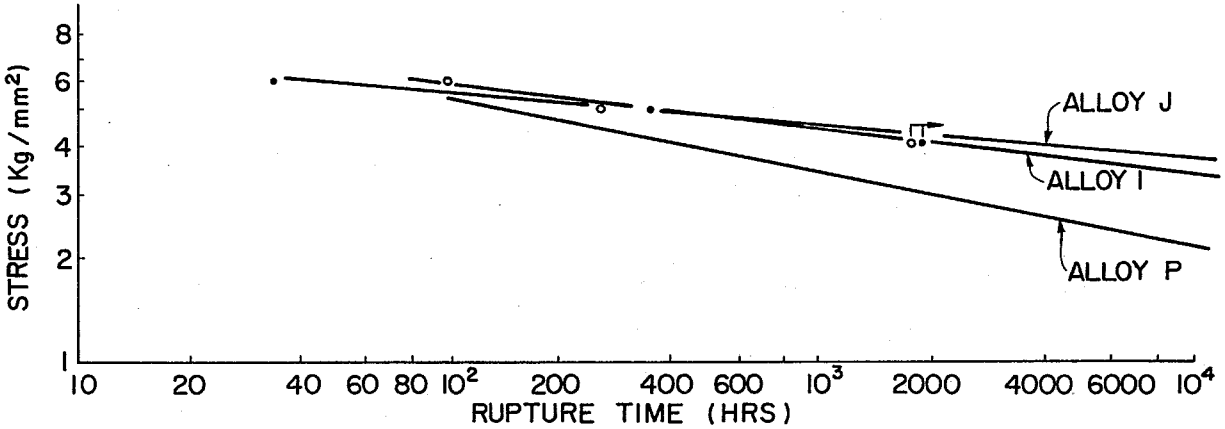

All the samples were prepared in a high frequency melting furnace according to the investment casting method. The samples were cast-molded to have a size of 100 mm × 200 mm × 15 mm. The mold-preheating temperature was 900° C. and the casting temperature was 1545° C. After solidification, the samples were cooled in the furnace at 1121° to 1175° C. over a period of 4 hours and cooled to 927° C. in the furnace. At this temperature, the samples were heat-treated for 10 hours. Then, the samples were cooled to 538° C. in the furnace, and then, they were air-cooled. From these samples, test pieces having a diameter of 6.0 mm and a parallel portion length of 30 mm were prepared as test pieces to be subjected to the creep rupture test described below. Further, test pieces for a observation of the microstructure were immersed for about 10 seconds in a corrosive solution containing $H_2O$, HCl and $H_2O_2$ at a mixing ratio of 5 : 5 : 1 and then, they were lightly polished by buffing. Then, the microstructures of the so treated test pieces were observed under a microscope of 400 magnifications to obtain results shown in FIG. 1. FIG. 1-a shows the microstructure of the alloy No. P, and FIGS. 1-b and 1-c show the microstructures of the alloys Nos. D and H, respectively.

in the microstructure shown in FIG. 1-a, a lamellar eutectic carbide and a secondarily precipitated carbide around the lamellar carbide are observed as indicated by arrows. The lamellar eutectic carbide appeared when the alloy was solidified, and the secondary carbide was precipitated at the heat treatment. It is construed that each of these carbides is $Cr_{21}W_2C_6$.

The shape, size and distribution of these eutectic and secondarily precipitated carbides have important influences on high temperature characteristics of the alloy. As compared with the conventional cobalt base alloy shown in FIG. 1-a, the size of the eutectic carbide is small and its shape is round in the alloy No. D of the present invention comprising titanium and niobium, which is shown in FIG. 1-b. Further, formation of secondarily precipitated carbides is reduced and they are present in the dispersed state. In the case of the alloy No. H of the present invention comprising titanium, niobium and mischmetal, which is shown in FIG. 1-c, the size of the eutectic carbide is small and its shape is round, and formation of secondarily precipitated carbides is much reduced and they are present in the finely dispersed state. The effects attained in the present invention by addition of titanium, niobium and mischmetal will readily be understood from these FIGS. Namely, by addition of titanium, niobium and mischmetal, precipitation of carbides is highly controlled and the precipitated carbides are very finely dispersed, whereby the high temperature ductility of the cobalt base alloy is highly improved.

FIG. 2 illustrates the microstructures of the sample alloys observed under a microscope after they had been subjected to the creep rupture test mentioned below at 982° C. (1800° F.). FIG. 2-a shows the microstructure of the conventional alloy No. P and FIG. 2-b shows the ruptured face of the same alloy No. P. FIG. 2-c shows the microstructure of the alloy No. H of the present invention and FIG. 2-d shows the ruptured face of the same alloy No. H.

From FIG. 2-a it is seen that in the microstructure of the alloy No. P no great change was caused on the eutectic carbide by the creep rupture test conducted at 982° C. but the density of the secondarily precipitated carbide was slightly lowered. From FIG. 2-b it is seen that in the alloy No. P the crystalline structure was hardly elongated in the stress direction at the time of rupture, and cracks were observed along the grain boundary. Thus, it is seen that the alloy No. P was very brittle and was readily ruptured at the rupture test.

From FIG. 2-c it is seen that in the microstructure of the alloy No. H of the present invention no great change was caused on the structure of the secondarily precipitated carbide by the creep rupture test but the shape of the eutectic carbide was rounded by the creep rupture test. When the ruptured face of the alloy No. H shown in FIG. 2-d is examined, it is seen that the crystalline structure was elongated in the stress direction and the high temperature ductility was highly improved in this alloy.

With respect to each of the foregoing samples, the oxygen and nitrogen contents were determined according to the gas analysis method to obtain results shown in Table 2. In general, there is some mutual relation between the oxygen and nitrogen contents, and as the oxygen content is low, also the nitrogen content is low.

Table 2

| Alloy No. | Nitrogen Content (ppm) | Oxygen Content (ppm) |
|---|---|---|
| P | 669 | 253 |
| A | 277 | 120 |
| B* | 356 | 46 |
| C | 448 | 67 |
| D | 394 | 64 |
| E | 266 | 39 |
| F* | 296 | 20 |
| G | 420 | 82 |
| H* | 212 | 16 |
| I | 443 | 104 |
| J | 443 | 98 |

*Mischmetal was added.

As is seen from the results shown in Table 2, in each of the cobalt base alloys of the present invention (alloys Nos. A to J) both the oxygen and nitrogen contents were lower than in the conventional cobalt base alloy (alloy No. P). The oxygen content was remarkably reduced in the alloys Nos. B, F and H, each including mischmetal. Thus, it is construed that in the cobalt base alloy of the present invention, both the oxygen and nitrogen contents can be remarkably reduced by high deoxidizing and denitrificating activities of titanium and niobium and the deoxidizing and denitriding effects of these elements are highly enhanced by addition of mischmetal.

It is considered that oxygen and nitrogen are present in the alloy in the interstitial state in the matrix. As amounts of interstitial gaseous components are large, the ductility of the matrix is proportionally reduced. Further, in the cobalt base alloy the high temperature ductility is reduced by the presence of nitrides or oxides of chromium. In view of these facts, it is seen that the high temperature ductility of the cobalt base alloy of the present invention is improved also by reduction of the oxygen and nitrogen contents attained by addition of titanium, niobium and mischmetal.

As is apparent from the foregoing illustration, titanium, niobium and mischmetal incorporated into the cobalt base alloy of the present invention have not only an effect of controlling the amount and shape of the carbide but also an effect of reducing the oxygen and nitrogen contents. By these two effects, the high temperature ductility can be highly improved in the cobalt base alloy of the present invention.

FIGS. 3-a to 3-e are stress-rupture time graphs showing the rupture strength at 982° C. (1800° F.), which were obtained by subjecting the conventional cobalt base alloy No. P and the cobalt base alloys Nos. A to J of the present invention to the creep rupture test at 982° C. (1800° F.).

It is seen that each of the cobalt base alloys of the present invention had an improved creep rupture strength as compared to the conventional alloy No. P.

In order to facilitate comparison of the alloys shown in FIGS. 3-a to 3-e with respect to the strength, the values of the creep rupture strength at the points of $10^2$, $10^3$ and $10^4$ hours and the gradients were obtained from the stress-rupture time lines in FIGS. 3-a to 3-e, and the so obtained data are shown in Table 3.

Table 3

| Alloy No. | Creep Rupture Strength (Kg/mm²) $10^2$ hours | $10^3$ hours | $10^4$ hours | Gradient of Stress-Rupture Time Line |
|---|---|---|---|---|
| P | 5.4 | 3.4 | 2.1 | 0.20 |
| A | 6.6 | 4.3 | 2.9 | 0.19 |
| B* | 7.7 | 4.1 | 2.2 | 0.27 |
| C | 6.2 | 4.4 | 3.1 | 0.15 |
| D | 5.8 | 4.1 | 3.0 | 0.15 |
| E | 6.0 | 4.4 | 3.1** | 0.14 |
| F* | 5.7 | 4.6 | 3.6** | 0.09 |
| G | 6.2 | 4.5 | 3.2** | 0.14 |
| H* | 5.4 | 4.6 | 4.0** | 0.06 |
| I | 5.9 | 4.4 | 3.3** | 0.13 |
| J | 5.5 | 4.6 | 3.7** | 0.08 |

*0.3 % mischmetal was added.
**extrapolated more than 10 times.

A gas turbine engine to which the cobalt base alloy of the present invention is applied is used at high temperature over a long period of time. Accordingly, when cobalt base alloys are compared with each other with respect to the creep rupture strength, it is preferred that the comparison be made based on data obtained when the creep rupture test is conducted for a long time. When the data of the creep rupture strength on the column of "$10^4$ hours" of Table 3 are examined, it is seen that each of the cobalt base alloys of the present invention (alloys Nos. A to J) had a higher creep rupture strength than that of the conventional alloy No. P (2.1 Kg/mm²). When the cobalt base alloys of the present invention free of mischmetal (alloys Nos. A, C, D, E, G, I and J) are examined, it is seen that samples having higher titanium and niobium contents, for example, alloys Nos. G, I and J, had an especially high creep rupture strength. Further, in these samples, the gradients of the stress-rupture time lines were small, and hence, it is seen that in these samples, the reduction of the creep rupture strength with the lapse of time was very low.

When the alloys Nos. B, H and F of the present invention, in which mischmetal was incorporated, are examined, it is seen that these alloys had a higher creep rupture strength than the foregoing alloys of the present invention free of mischmetal. Especially, the alloy No. H had a creep rupture strength of 4.0 Kg/mm² at the point of $10^4$ hours and this value is about 2 times as high as the value attainable in the conventional cobalt base alloy. In each of the mischmetal-containing alloys of the present invention, the gradient of the stress-rupture time line was very small and it is seen that the reduction of the creep rupture strength with the lapse of time is very low.

Figure 4:
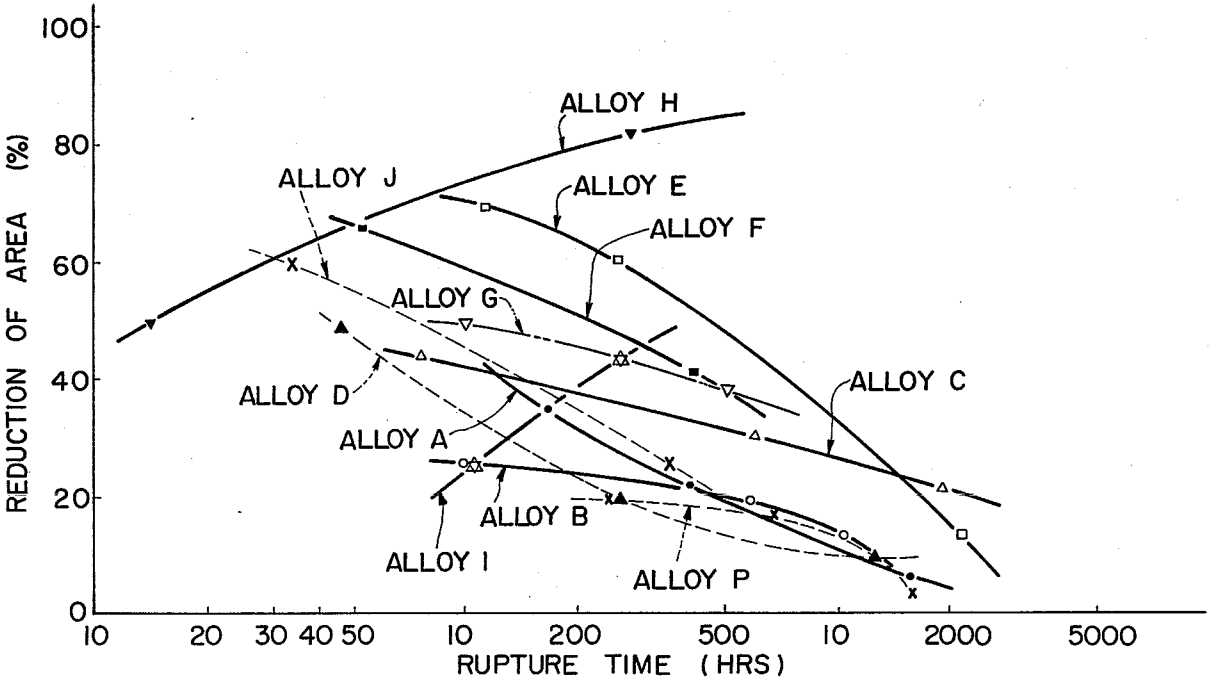
FIG. 4 illustrates the reduction of the area at rupture in the conventional cobalt base alloy and the cobalt base alloy of the present invention.

FIG. 4 illustrates the reduction of area observed when each of the sample alloys Nos. P and A to J were subjected to the creep rupture test. When alloys are subjected to the creep rupture test, a great number of cracks are formed in the samples and hence, the ductility cannot be evaluated based on the elongation alone. Therefore, the reduction of area was determined to evaluate the ductility precisely.

As is apparent from FIG. 4, each of the cobalt alloy bases of the present invention had a good reduction of area, which is owing to the effects of titanium, niobium and mischmetal. More specifically, by addition of titanium, niobium and mischmetal, precipitation and cohesion of carbides in the alloy are controlled and the oxygen and nitrogen contents are reduced, whereby the high temperature ductility is highly improved.

Among the alloys of the present invention, the alloy No. H had an especially high value of the reduction of area and it is seen that this high value was hardly reduced even after a long time had passed. As pointed out above, this alloy No. H had a highest value of the creep rupture strength among the sample alloys of the present invention.

As is apparent from the foregoing illustration, the cobalt base alloy of the present invention has both a high strength and a high ductility at high temperatures approximating 982° C. (1800° F.).

Although the present invention has been described in conjunction with the advantageous embodiments, it is to be understood that modifications and variations may be resorted to without departing from the spirit and scope of the invention, as those skilled in the art will readily understand. Such modifications and variations are considered to be within the scope of the invention and appended claims.

What is claimed is:

1. A cobalt base alloy consisting essentially of, in weight percent, about 0.2% to about 0.3% carbon, about 0.3% to about 2.0% silicon, about 0.3% to about 2.0% manganese, about 5.0% to about 15.0% nickel, about 26% to about 35% chromium, about 6.5% to about 7.5% tungsten, about 0.003% to about 0.1% boron, about 0.1% to 0.4% titanium and about 0.1% to about 0.6% niobium, and the balance being essentially cobalt together with impurities and incidental elements normally associated with a cobalt base alloy.

2. A cobalt base alloy consisting essentially of, in weight percent, about 0.2% to about 0.3% carbon, about 0.3% to about 2.0% silicon, about 0.3% to about 2.0% manganese, about 5.0% to about 15.0% nickel, about 26.0% to about 35.0% chromium, about 6.5% to about 7.5% tungsten, about 0.003% to about 0.1% boron, about 0.1% to about 0.4% titanium, about 0.1% to about 0.6% niobium and about 0.3% mischmetal, and the balance being essentially cobalt together with impurities and incidental elements normally associated with a cobalt base alloy.

3. A cobalt base alloy as set forth in claim 2, wherein said nickel is 9.5% to 11.5%, said chromium is 28.5% to 30.5%, and said boron is 0.005% to 0.015%.

4. A cobalt base alloy consisting essentially of, in weight percent, about 0.2% to about 0.3% carbon, about 0.3% to about 2.0% silicon, about 0.3% to about 2.0% manganese, about 5.0% to about 15.0% nickel, about 26% to about 35% chromium, about 6.5% to about 7.5% tungsten, about 0.003% to about 0.1% boron, about 0.1% to 0.4% titanium, about 0.05% to about 1.0% mischmetal, and about 0.1% to about 0.6% niobium, and the balance being essentially cobalt together with impurities and incidental elements normally associated with a cobalt base alloy.

* * * * *